United States Patent [19]

Hamada

[11] Patent Number: 5,000,203

[45] Date of Patent: Mar. 19, 1991

[54] FOREIGN MATTER REMOVING METHOD

[75] Inventor: Yoshinori Hamada, Osaka, Japan

[73] Assignee: Nitto Denko Corp., Osaka, Japan

[21] Appl. No.: 334,520

[22] Filed: Apr. 7, 1989

[51] Int. Cl.[5] ..... B08B 3/12

[52] U.S. Cl. ..... 134/1; 134/25.3

[58] Field of Search ..... 134/1, 25.3; 15/1.5 R, 15/3, 3.1; 209/127.1, 29

[56] References Cited

U.S. PATENT DOCUMENTS

| | | | |
|---|---|---|---|
| 3,156,547 | 11/1964 | Fleck . | |
| 3,308,944 | 3/1967 | Chamberlain et al. | 209/129 |
| 3,407,930 | 10/1968 | Morel et al. | 209/129 |
| 4,738,772 | 4/1988 | Giesfoldt | 209/127.1 |

FOREIGN PATENT DOCUMENTS 718898 11/1954 United Kingdom .

*Primary Examiner*—Curtis R. Davis

*Attorney, Agent, or Firm*—Sughrue, Mion, Zinn, Macpeak & Seas

[57] ABSTRACT

Dielectric foreign matters are removed from objects such as foodstuffs by attracting the dielectric foreign matters by an electrostatic force toward an electrode portion of a static electricity generating device and sticking the attracted foreign matters to an adhesive surface of an adhesive layer disposed between the electrode portion and the objects. Magnetic foreign matters are also removed from the objects by attracting the magnetic foreign matters by a magnetic force toward a magnetic pole portion of a magnetic force generating device, and sticking the attracted foreign matters to an adhesive surface of an adhesive layer.

8 Claims, 2 Drawing Sheets

FOREIGN MATTER REMOVING METHOD

BACKGROUND OF THE INVENTION

1. Field of the Invention

This invention relates to a method for removing dielectric and/or magnetic foreign matters from objects being processed, utilizing static electricity and/or magnetic force.

2. Prior Art

There is known, for example, a method in which dielectric foreign matters such as a small insect and a hair mixed in foodstuffs are removed therefrom utilizing static electricity to keep the foodstuffs sanitary. In this conventional method, a high voltage is applied to an electrode portion of a static electricity generating device so as to attract to a surface of the electrode portion dielectric foreign matters which have bee introduced into objects being processed (foodstuffs). Then, the foreign matters thus stuck to the electrode surface are blown off by a blast of air and are drawn into a duct, thereby removing the dielectric foreign matters.

Another method is known to remove foreign matters of a magnetic nature, such as particles of iron, which have been introduced into objects being processed (e.g., a foodstuff, plastic product or electronic component) during various treatments. In this known method, the removal of such magnetic foreign matters is effected utilizing a magnetic force. More specifically, a magnetic pole portion of an electromagnet or a permanent magnet is disposed close to a conveyer line along which the objects are being transferred, so that the magnetic pole portion can attract such magnetic foreign matters mixed in the objects. Then, in the case of the electromagnet, the thus attracted foreign matters are separated from the magnetic pole portion for collection by inverting the polarity of the electromagnet at suitable frequency. In the case of the permanent magnet, such attracted foreign matters are removed from the permanent magnet by mechanically scratching them off the magnetic pole portion.

With the former method, however, upon lapse of several seconds after the sticking of the dielectric foreign matters by electrostatic induction to the electrode portion having a polarity opposite to that of the charges of the attracted dielectric foreign matters, electric charges of the same polarity as the electrode portion is accumulated on the attracted dielectric foreign matters. As a result, the foreign matters tend to separate from the electrode portion to drop on the objects being processed.

A problem with the latter method is that part of the fine magnetic foreign matters tend to remain on the surface of the magnetic pole portion, which periodically requires such operation that the transfer of the objects and manufacturing processes are stopped in order to clean the magnetic pole portion. This is undesirable from the viewpoint of productivity.

SUMMARY OF THE INVENTION

With the above problems of the prior art in view, it is an object of this invention to provide a method for removing dielectric and/or magnetic foreign matters from objects, which can easily and positively capture the foreign matters and can collect the captured foreign matters.

According to a first aspect of the invention, a method for removing dielectric foreign matters from objects comprises the steps of: attracting the dielectric foreign matters by an electrostatic force toward an electrode portion of static electricity generating means; and sticking the attracted dielectric foreign matters to an adhesive surface of an adhesive layer disposed between the electrode portion and the objects.

With the first aspect, the dielectric foreign matters can be positively kept captured by the adhesive surface and will not drop on the objects.

According to a second aspect of the invention, a method for removing magnetic foreign matters from objects comprises the steps of: attracting the magnetic foreign matters by a magnetic force toward a magnetic pole portion of a magnetic force generating means; and sticking the attracted magnetic foreign matters to an adhesive surface of an adhesive layer disposed between the magnetic pole portion and the objects.

With the second aspect, the magnetic foreign matters can be positively kept captured by the adhesive surface. Since the magnetic foreign matters are not directly stuck to the magnetic pole portion, it is not necessary to remove the magnetic foreign matters from the magnetic pole portion.

According to a third aspect of the invention, a method for removing dielectric and magnetic foreign matters from objects comprises the steps consisting of a series combination of the first aspect and the second aspect of the invention, with the adhesive layer being commonly used.

With the third aspect, because both the dielectric and magnetic foreign matters can be removed from the objects at the same time, the foreign matters can be removed quite efficiently.

In particular, in each of the above three aspects, the adhesive layer may be a strip-like tape consisting of a supporting material and an adhesive coated thereon. In this case, because the adhesive tape on which the foreign matters are stuck is successively wound up, the adhesive force of the adhesive layer can be maintained and the captured foreign matters can be easily collected.

DETAILED DESCRIPTION OF THE PREFERRED EMBODIMENTS

Figure 1:
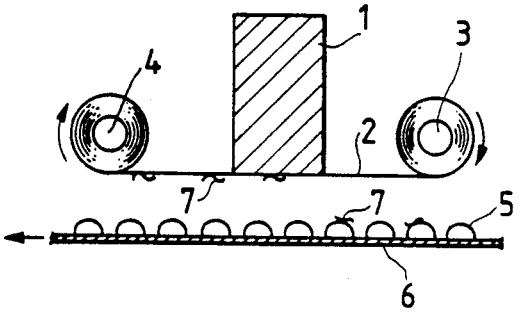
FIG. 1 is a schematic view of a dielectric foreign matter removing method according to a first aspect of the present invention.

The invention will now be described with reference to the drawings in which like reference numerals denote corresponding parts.

FIG. 1 shows an apparatus to which a first preferred embodiment of a foreign matter removing method of the present invention is applied. This apparatus comprises a static electricity generating device (not shown) having an electrode portion 1, a strip-like adhesive tape 2 having an adhesive surface on a bottom side thereof, a supply roller 3 for supplying the adhesive tape 2, and a winding roller 4 for winding up the adhesive tape 2. The adhesive tape 2 is fed from the supply roller 3 to the winding roller 4 along a horizontal path either continuously or intermittently by driving the winding roller 4 with a motor (not shown). The electrode portion 1 is disposed between the supply roller 3 and the winding roller 4, and has a flat lower end face held in sliding contact with a top side of the adhesive tape 2. This top side of the adhesive tape 2 is not provided with any adhesive while the bottom side is coated with an adhesive. A conveyer 6 is disposed horizontally below the part of the adhesive tape 2 lying between the supply and winding rollers 3 and 4. Objects 5 being processed, such as foodstuffs, are placed on the conveyer 6 and transferred with it.

The adhesive tape 2 can be of any type so long as it has electrical insulating properties. For example, there can be used an adhesive tape comprising a base material such as a plastic material, paper or a nonwoven fabric, and an adhesive of acrylic or rubber type coated on the base material. The adhesive tape 2 is required to have adhesiveness (180° peeling adhesive strength) of at least 100 g/25 mm and preferably 200 to 3000 g/25 mm at the condition of 300 m/min. pulling speed, 23° C., and 60% relative humidity. Here in this embodiment, the adhesive tape 2 comprises a base material of a nonwoven fabric and an adhesive coated thereon, and has a volume resistivity of $10^{13}$ Ωcm or more. A high voltage of 10 kV or more is applied to the electrode portion 1, and the distance between the electrode portion 1 and the objects 5 is 5 to 100 mm.

When a high voltage is applied to the electrode portion 1, electric charges are accumulated on the surface of the electrode portion 1. As a result, electric charges of a polarity opposite to that of the charges of the electrode surface are induced at the bottom side of the part of the adhesive tape 2 being held in contact with the lower end of the electrode portion 1. Further, electric charges of a polarity opposite to that of the charges of the adhesive tape 2 are induced in the objects 5 and also in dielectric foreign matters 7 such as a hair and a small insect mixed in the objects 5. Such dielectric foreign matters 7 are much lighter than the objects 5, and therefore are attracted toward the adhesive tape 2 by the Coulomb force resulting from the electrostatic induction, so that the dielectric foreign matters 7 are stuck to the adhesive coating on the bottom side of the adhesive tape 2. Even when charges of the same polarity as that of the adhesive tape 2 are accumulated on the dielectric foreign matters 7 thus stuck to the adhesive tape 2, these dielectric foreign matters are positively kept captured by the adhesive force of the adhesive tape 2. Therefore, even if external vibration is applied to the adhesive tape 2, the thus captured dielectric foreign matters 7 will not drop from the adhesive tape 2. The adhesive tape 2 to which the dielectric foreign matters 7 adhere is successively wound up by the winding roller 4, and a fresh part of the adhesive tape 2 is fed from the supply roller 3 to the operative area between the supply and winding rollers 3 and 4. Therefore, the adhesive surface (i.e., the bottom side) of the adhesive tape 2 overlying the objects 5 being processed always has a sufficient adhesiveness to positively hold the attracted dielectric foreign matters 7. Thus, the removal of the dielectric foreign matters 7 from the objects 5 can be positively effected for a long period of time. In some cases, it is preferred that the conveyer 6 be electrically conductive and be of vibration-exciting type.

Figure 2:
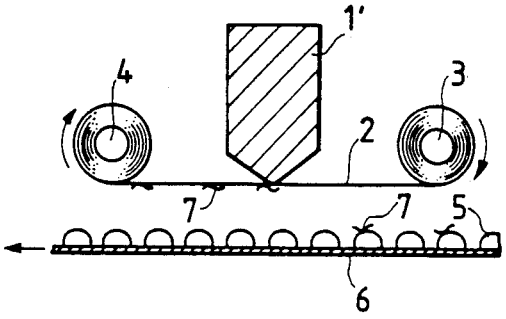
FIGS. 2 and 3 are schematic views showing modifications of the method of FIG. 1.

FIG. 2 shows an apparatus to which a second preferred embodiment of the invention is applied. This apparatus differs from the apparatus of FIG. 1 in that the lower end of an electrode portion 1' of a static electricity generating device is formed into a relatively sharp edge so that the lower end of the electrode portion 1' held in sliding contact with the adhesive tape 2 has a triangular cross-section. With this structure, the electric charges produced by electrostatic induction have a higher density so that the electrode portion 1' of this embodiment can have a better ability to attract the dielectric foreign matters 7 than the electrode portion 1 of FIG. 1.

Figure 3:
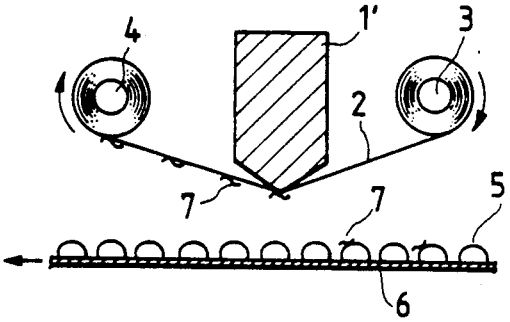

FIG. 3 shows an apparatus to which a third preferred embodiment of the present invention is applied. This apparatus differs from the apparatus of FIG. 2 in that the lower sharp edge of the electrode portion 1' urges the adhesive tape 2 downwardly toward the conveyer 6, so that the adhesive tape 2 is bent into V-shape between the two rollers 3 and 4. With this arrangement, the density of the electric charges induced at the bottom side of the adhesive tape 2 become further higher, thereby further enhancing the ability to attract the dielectric foreign matters 7.

In the above embodiments, the explanation is made for the case of removing the foreign matters such as a small insect and hair from the objects such as foodstuffs, but the invention is applicable in various ways. For example, the invention can be applied to the collecting part of an electric dust collector.

Figure 4:
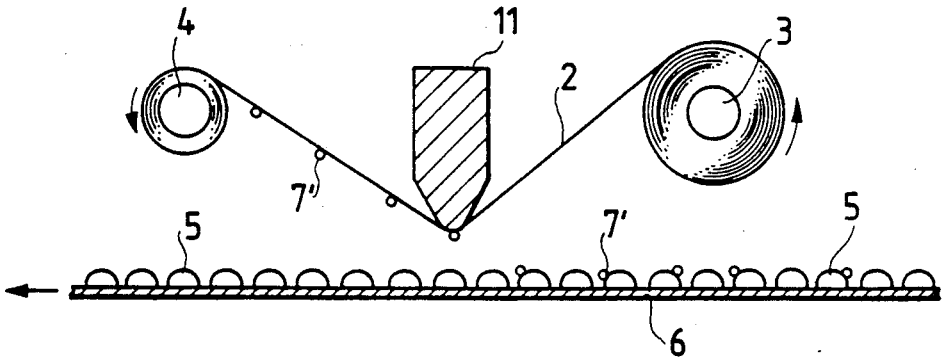
FIG. 4 is a schematic view of a magnetic foreign matter removing metthod according to a second aspect of the present invention.

FIG. 4 shows an apparatus to which a fourth preferred embodiment of a foreign matter removing apparatus of the present invention is applied. Like reference numerals as those in FIGS. 1 to 3 denote corresponding parts. The apparatus of this embodiment comprises a magnetic force generating device (not shown) having a magnetic pole portion 11, the magnetic force generating device employing an electromagnet. A voltage of a predetermined value is applied to the magnetic force generating device so that a magnetic force of 1000 Gauss or more is produced at the magnetic pole portion 11. The lower end of the magnetic pole portion 11 is tapered and is in sliding contact with a top surface of an adhesive tape 2. The lower end of the magnetic pole portion 11 urges the adhesive tape 2 downwardly toward the conveyer 6. Objects 5 such as a foodstuff or a plastic molded product are placed on a conveyer 6 disposed below the adhesive tape 2, and are conveyed with it, as described above for the preceding embodiments.

In this embodiment, the adhesive tape 2 is rolled around a supply roller 3 and a winding roller 4 in such a manner that an adhesive surface of the adhesive tape 2 becomes an inside surface of a roll. As described above, the type of the adhesive tape 2 is not particularly limited. Here in this embodiment, the adhesive tape 2 comprises a base material of a polyethylene-type film having thickness of 0.1 to 0.2 mm and an adhesive coated on one side of the base material. The adhesive tape has a volume resistivity of $10^{15}$ Ωcm or more.

The operation of the apparatus of this embodiment will now be described.

When a magnetic force is produced at the magnetic pole portion 11, magnetic foreign matters 7' mixed in the objects 5 being processed are attracted toward the magnetic pole portion 11 and stuck to the adhesive surface (i.e., the bottom side) of the adhesive tape 2, thus positively capturing the magnetic foreign matters 7' by the adhesive force. Therefore, even if external vibration is applied to the adhesive tape 2, the magnetic foreign matters 7' thus captured will not be separated from the adhesive tape 2. The adhesive tape 2 to which the magnetic foreign matters 7' adhere is wound up by the winding roller 4, and a fresh part of the adhesive tape 2 is fed from the supply roller 3 to the operative area between the supply and winding rollers 3 and 4. Therefore, the adhesive surface (i.e., the bottom side) of the adhesive tape 2 overlying the objects 5 being processed always has a sufficient adhesiveness to positively hold the attracted magnetic foreign matters 7'. Thus, the removal of the magnetic foreign matters 7' from the objects 5 can be positively effected for a long period of time.

Figure 5:
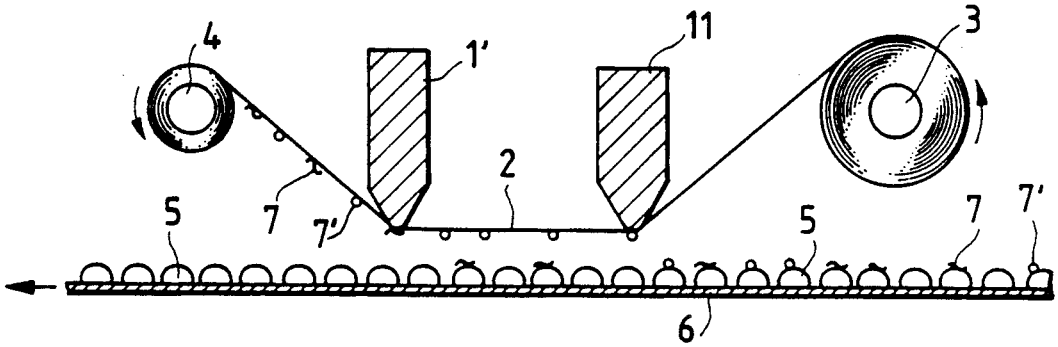
FIG. 5 is a schematic view of a dielectric and magnetic foreign matter removing method according to a third aspect of the present invention.

FIG. 5 shows an apparatus to which a fifth preferred embodiment of the invention is applied. In this apparatus, an electrode portion 1' of a static electricity generating device is installed downstream of the magnetic pole portion 11 in a path of travel of an adhesive tape 2. The magnetic pole portion 11 and the electrode portion 1' are held in sliding contact with the adhesive tape 2. The part of the adhesive tape 2 lying between the magnetic pole portion 11 and the electrode portion 1' is disposed in parallel to the conveyer 6, being urged toward the conveyer 6. Apparently, the electrode portion 1' may be disposed upstream of the magnetic pole portion 11. With this embodiment, the magnetic foreign matters 7' mixed in the objects 5 are attracted toward the magnetic pole portion 11 and adhere to the adhesive surface of the adhesive tape 2, whereas the dielectric foreign matters 7 mixed in the objects 5 are attracted toward the electrode portion 1' and also adhere to the adhesive surface of the adhesive tape 2.

While the foreign matter removing method according to the present invention have been specifically shown and described herein, the invention itself is not to be restricted to the exact showing of the drawings and the description thereof.

For example, although in the above embodiments the electrode portion 1 (1') and the magnetic pole portion 11 are held in contact with the adhesive tape 2, this is not always necessary, but it will suffice that the adhesive tape 2 is disposed between the objects 5 and each of the electrode portion and the magnetic pole portion.

Figure 6:
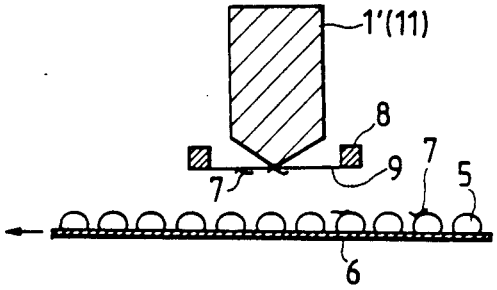
FIGS. 6 and 7 are schematic views showing other modifications.

Although in the above embodiments the adhesive tape 2 is wound up by the winding roller 4, this is not always necessary. For example, as shown in FIG. 6, a predetermined length of an adhesive tape 9 can be used instead of the adhesive tape 2, in which the adhesive tape 9 is fixed to a frame 8 and is disposed between the objects 5 and an electrode portion 1' (or the magnetic pole portion 11). When the adhesiveness of the adhesive tape 9 is reduced, the adhesive tape 9 may be replaced by a new one.

Figure 7:
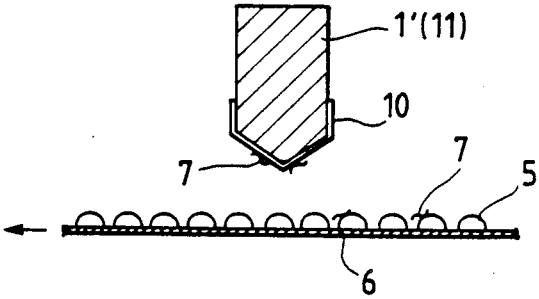

Further, although in the above embodiments, the adhesive tape 2 has the adhesive on only one side, an adhesive-double-coated tape 10 having adhesives coated on both sides may be used. In this case, the adhesive-double-coated tape 10 is bonded to a lower surface of an electrode portion 1' (or a magnetic pole portion 11), as shown in FIG. 7.

Still further, instead of the adhesive-double-coated tape 10, an adhesive agent can be coated on a lower surface of a electrode portion (or a magnetic portion) to form an adhesive layer which can be easily peeled off.

In short, it will suffice that the adhesive layer is interposed between the objects 5 and the electrode portion and/or the magnetic pole portion so as to adhesively hold the dielectric and/or magnetic foreign matters.

As described above, the dielectric and/or magnetic foreign matters are attracted to the adhesive layer by the static electricity and/or the magnetic force and are positively held by the adhesive layer. Therefore, the dielectric foreign matters, once captured by the adhesive layer, will not drop on the objects 5 being processed. Further, since the adhesive layer to which the dielectric and/or magnetic foreign matters adhere can be discarded or disposed of, it is not necessary to clean the magnetic pole portion, thus facilitating the maintenance. Furthermore, with the method of FIG. 5, both dielectric and magnetic foreign matters can be removed at the same time, and therefore such removal can be carried out quite efficiently. Further, the use of the supply and winding rollers 3 and 4 ensures a constant adhesive force of the adhesive tape, and also facilitates the collection of the caprured foreign matters.

What is claimed is:

1. A method for removing foreign matter from objects being processed, comprising the steps of:
   attracting dielectric foreign matter by an electrostatic force toward an electrode portion of a static electricity generating means for generating static electricity; and
   adhering said dielectric foreign matter to an adhesive surface of an adhesive layer disposed between said electrode portion and said objects, said adhesive surface being opposed to said objects.

2. A method for removing foreign matter from objects being processed, comprising the steps of:
   attracting magnetic foreign matter by a magnetic force toward a magnetic pole portion of a magnetic force generating means for generating said magnetic force; and
   adhering said magnetic foreign matter to an adhesive surface of an adhesive layer disposed between said magnetic pole portion and said objects, said adhesive surface being opposed to said objects.

3. A method for removing foreign matter from objects being processed, comprising the steps of:
   attracting dielectric foreign matter by an electrostatic force toward an electrode portion of a static electricity generating means for generating static electricity;
   adhering said dielectric foreign matter to an adhesive surface of an adhesive layer disposed between said electrode portion and said objects, said adhesive surface being opposed to said objects;
   attracting magnetic foreign matter by a magnetic force toward a magnetic pole portion of a magnetic force generating means for generating said magnetic force; and
   adhering said magnetic foreign matter to said adhesive surface of said adhesive layer, said adhesive surface being opposed to said objects.

4. A method as claimed in claim 1, 2 or 3, further comprising the step of successively feeding a new part of said adhesive layer.

5. A method as claimed in claim 1, 2 or 3, further comprising the step of transferring said objects under said adhesive layer.

6. A method as claimed in claim 1, wherein said electrode portion is in slidable contact with a top surface of said adhesive layer.

7. A method as claimed in claim 2, wherein said magnetic pole portion is in slidable contact with said adhesive layer.

8. A method as claimed in claim 3, wherein said electrode portion and said magnetic pole portion is in slidable contact with said adhesive layer.

* * * * *